US008534381B1

(12) United States Patent
Rinald

(10) Patent No.: US 8,534,381 B1
(45) Date of Patent: Sep. 17, 2013

(54) HIGH LCM POSITIVE PULSE MWD COMPONENT

(71) Applicant: Aim Directional Services, LLC, Corpus Christi, TX (US)

(72) Inventor: Thomas Rinald, Corpus Christi, TX (US)

(73) Assignee: Aim Directional Services, LLC, Corpus Christi, TX (US)

( * ) Notice: Subject to any disclaimer, the term of this patent is extended or adjusted under 35 U.S.C. 154(b) by 0 days.

(21) Appl. No.: 13/734,690

(22) Filed: Jan. 4, 2013

Related U.S. Application Data

(60) Provisional application No. 61/584,137, filed on Jan. 6, 2012.

(51) Int. Cl.
*E21B 47/18* (2012.01)

(52) U.S. Cl.
USPC ..... 175/40; 367/83; 340/855.4

(58) Field of Classification Search
USPC ..... 175/40–50, 314, 320–326, 424; 166/296, 166/56, 227–236, 242.1, 243; 340/853.1–856.4; 367/83–85
See application file for complete search history.

(56) References Cited

U.S. PATENT DOCUMENTS

| | | | | | |
|---|---|---|---|---|---|
| 3,831,753 | A | | 8/1974 | Gaylord et al. | |
| 3,958,217 | A | * | 5/1976 | Spinnler | 367/83 |
| 4,550,392 | A | | 10/1985 | Mumby | |
| 5,040,155 | A | * | 8/1991 | Feld | 367/85 |
| 5,333,686 | A | | 8/1994 | Vaughan et al. | |
| 5,473,579 | A | * | 12/1995 | Jeter | 367/85 |
| 5,603,385 | A | | 2/1997 | Colebrook | |
| 5,660,238 | A | | 8/1997 | Earl et al. | |
| 5,740,127 | A | * | 4/1998 | Van Steenwyk et al. | 367/85 |
| 6,484,817 | B2 | | 11/2002 | Innes | |
| 6,636,159 | B1 | * | 10/2003 | Winnacker | 340/854.3 |
| 7,057,524 | B2 | * | 6/2006 | Innes | 340/855.4 |
| 7,180,826 | B2 | * | 2/2007 | Kusko et al. | 367/85 |
| 7,408,837 | B2 | * | 8/2008 | Harvey | 367/85 |
| 7,673,705 | B2 | | 3/2010 | Gearhart et al. | |
| 8,174,929 | B2 | * | 5/2012 | Camwell et al. | 367/83 |
| 2006/0072374 | A1 | * | 4/2006 | Kusko | 367/83 |
| 2008/0179093 | A1 | * | 7/2008 | Kusko et al. | 175/40 |

OTHER PUBLICATIONS

Dictionary definition of "abut" accessed May 31, 2013 via thefreedictionary.com.*
Screen shot of www.kambi.ca, Mud Pulse Telementry, Jan. 4, 2013 (1 page).
Two photographs of an MWD Pulsar module manufactured by Tolteq, Jan. 4, 2013 (2 pages).

* cited by examiner

*Primary Examiner* — William P Neuder
*Assistant Examiner* — Blake Michener
(74) *Attorney, Agent, or Firm* — Gunn, Lee & Cave, P.C.

(57) ABSTRACT

The High LCM Positive Pulse MWD Component is designed to reduce the entry of LCM and debris into traditional positive pulse MWD systems by utilizing a screen positioned over the fluid ports. The component modifies the traditional poppet housing utilized in positive pulse MWD systems without changing the parameters of the fluid ports or changing the operation or need to recalibrate standard positive pulse MWD systems.

20 Claims, 5 Drawing Sheets

HIGH LCM POSITIVE PULSE MWD COMPONENT

CROSS-REFERENCES TO RELATED APPLICATIONS

This application claims the benefit of U.S. provisional application Ser. No. 61/584,137 filed Jan. 6, 2012 and entitled Protective Screen for Positive Pulse MWD Tool, which is incorporated by reference herein.

STATEMENT REGARDING FEDERALLY SPONSORED RESEARCH OR DEVELOPMENT

Not applicable.

BACKGROUND OF THE INVENTION

1. Field of the Invention

The present invention relates to an improved lower end for a positive pulse measurement while drilling (MWD) tool. Specifically, the improved lower end has the ability to prevent or reduce the entry of lost circulation material (LCM) and debris into the lower end through standard mud port holes. Reducing the entry of LCM and debris, especially larger sized LCM and debris, helps prevent the signal shaft from clogging or becoming inoperable.

2. Description of the Related Art

Positive pulse MWD tools are commonly used in the oil and gas industry as an effective means for determining the real-time location of the drill bit for purposes of making adjustments to drilling strategies. The standard positive pulse MWD system is comprised of multiple tubular housings comprising of at least a helix housing, poppet housing, pulser, directional module, and battery housing, among others.

The traditional positive pulse MWD system relies on a signal shaft or piston to interrupt the flow of drilling mud within the drilling string. This interruption of the drilling mud flow results in a positive pulse that machinery outside the well interprets to determine the location of the drill. An example of a typical MWD system is described in U.S. Pat. No. 5,333,686. The standard poppet housing is a tube with a substantially uniform outer diameter throughout the length of the poppet housing with a series of fluid ports located near the downwell end.

Traditional positive pulse MWD lower ends suffer from repeated clogging from debris or lost circulation material (LCM) entering the fluid ports located on the poppet housing of the lower end. During normal drilling operations, drilling mud is lost into the formation due to cracks in the rock or other geographic features. When enough drilling mud is lost to affect operations, drillers pump LCM down the drill string in an effort to seal up the cracks within the formation. LCM is comprised of numerous different types of material such as pieces of cotton seed hulls, walnut shells, seeds, bark, etc. that have sufficient volume and mass capable of filling the cracks in the formation that result in loss of drilling mud. Other debris also may present in drilling mud from cuttings not properly filtered as drilling mud is recycled.

Standard positive pulse MWD tools may become clogged and ineffective due to LCM or other debris entering the drilling fluid port(s). When this occurs, the signal shaft ceases to operate properly and the entire drill string must be removed so the lower end and signal shaft can be cleared of debris. Depending on the depth of the drill string, this clogging may result in a 12 to 24 hour delay, costing tens of thousands of dollars, while the signal shaft is cleared of debris. A secondary result of the common clogging of the lower end is that drillers tend to utilize less LCM which reduces the effectiveness of preventing the loss of drilling mud. As a result, many operators reduce LCM flow rates from the standard of 40 to 50 pounds per barrel to 15 pounds per barrel.

BRIEF SUMMARY OF THE INVENTION

The present invention is a modified version of the standard positive pulse MWD system for operation in a high lost circulation material (LCM) environment. The present invention maintains the same fluid port holes, at the same outer diameter and size, but is modified to accommodate a cylindrical screen positioned over the fluid port holes. The use of the same size, position, and location of the fluid port holes as a standard poppet housing obviates the need to recalibrate the positive pulse MWD system or conduct testing to ensure proper operation. The screen is prevented from moving longitudinally along the wellbore by a tapered section of the poppet housing and a connector ring attached to the downwell end of the poppet housing. The tapered section of the poppet housing matches the outer diameter of the screen and connector ring to prevent any shoulders that may hinder insertion of the tool into the wellbore or interrupt the flow of drilling mud.

The screen has slits that prevent LCM and other debris from entering the fluid ports and disrupting operation of the signal shaft. While fluid ports in standard poppet housings allow particles with a maximum dimension of 3/16 of an inch to enter, the preferred embodiment of the screen only allows particles with a maximum dimension of 1/32 of an inch. This reduction in size of the particles prevents the entry of larger sized particles that are capable of inhibiting the function of the signal shaft. Furthermore, particles that are capable of passing through the screen are generally sufficiently small to not disrupt operation of the signal shaft.

DETAILED DESCRIPTION OF THE INVENTION

When used with reference to the FIG.s, unless otherwise specified, the terms "upwell," "above," "top," "upper," "downwell," "below," "bottom," "lower," and like terms are used relative to the direction of normal drilling through a formation. Thus, normal drilling operations result in a production string originating from the surface downwell without regard to whether the tubing string is disposed in a vertical wellbore, a horizontal wellbore, or some combination of both.

Figure 1:
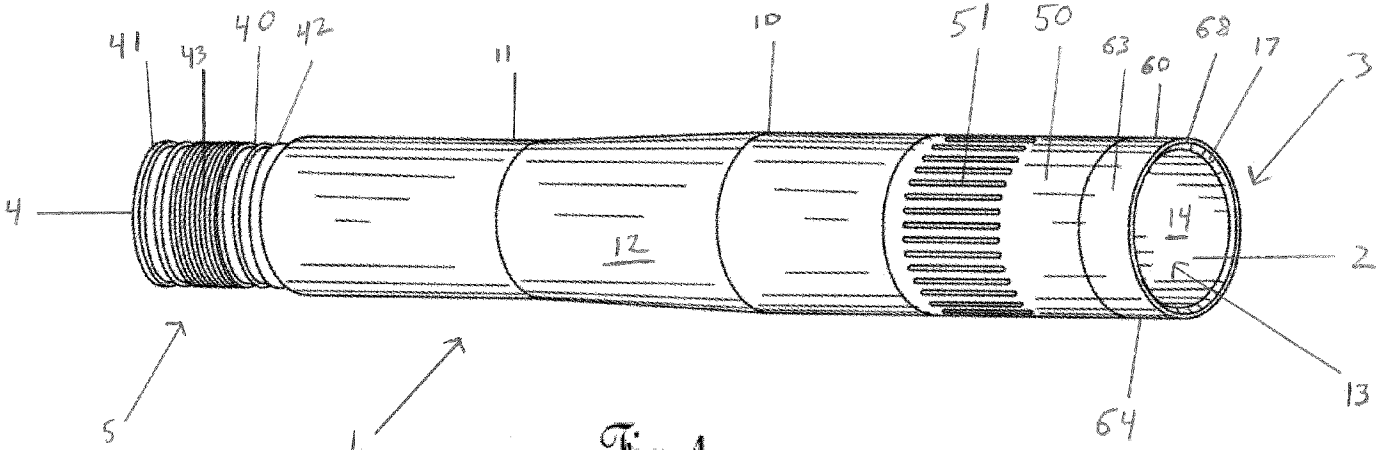
FIG. 1 is a profile view of the preferred embodiment.

FIG. 1 shows a side profile view of the preferred embodiment of the present invention 1. The preferred embodiment 1 comprises a poppet housing 10, screen 50 and connector ring 60. The preferred embodiment 1 is generally cylindrical and has a downwell opening 2 located at the downwell end 3 and an upwell opening 4 located at the upwell end 5. The downwell opening 2 and upwell opening 4 provide access to the substantially cylindrical interior cavity 13 of the preferred embodiment where fluid may flow between various MWD housings, generally flowing from upwell end 5 to downwell end 3.

As will be described herein, screen 50 is concentrically positioned around the poppet housing 10 and prevented from moving upwell or downwell by the poppet housing 10 and connector ring 60. Slits 51 are arranged along the circumference of the screen 40 and extend longitudinally, or parallel along the well bore. In other embodiments, the slits may be formed of a variety of different openings including but not limited to a plurality of holes or slits positioned latitudinally or perpendicular to the wellbore as long as slits are capable of preventing entry of LCM or other debris that would ordinarily enter through fluid ports (described herein).

Figure 2:
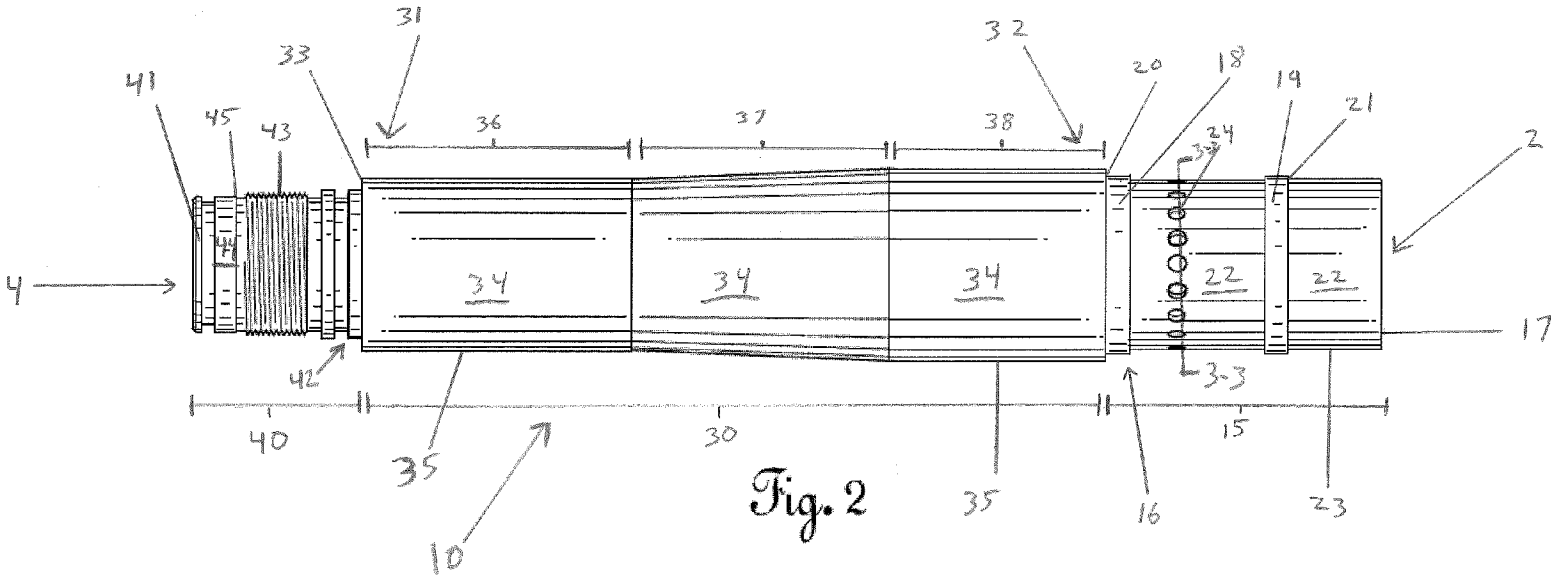
FIG. 2 is a side view of the preferred embodiment of the poppet housing.

FIG. 2 shows the side profile of the poppet housing 10 of the preferred embodiment. Poppet housing 10 is generally cylindrical in shape and comprised of three sections comprising a first section 15, tapered second section 30, and connecting third section 40. In the preferred embodiment, the first section 15, tapered second section 30, and connecting third section 40 are integral. Poppet housing 10 is generally constructed of beryllium copper.

Connecting third section 40 is cylindrical in shape having a terminal upwell end 41 and downwell end 42 that abuts tapered second section 30 at shoulder 33. External thread connectors 43 are circumferentially positioned on the exterior surface 44 of side wall 45 for purposes of threadably connecting with internally threaded standard upwell MWD componentry, such as batteries or additional housings.

The tapered second section 30 has a substantially cylindrical sidewall 35, an upwell end 31, and a downwell end 32. Upwell end 31 abuts connecting third section 40 creating shoulder 33. The diameter of tapered second section 30 at upwell end 31 is larger than the diameter of connecting third section 40. Standard upwell MWD componentry, once connected to the threadable connectors 43 of connector third section 40, abuts shoulder 33 and creates a generally seamless fit with the exterior surface 34 of sidewall 35 at the upwell end 31. In other words, the exterior diameter of standard upwell MWD componentry threadably connected to connector third section 40 is roughly the same exterior diameter of the sidewall 35 at the upwell end 31 of tapered second section 30. Thus, no sharp plateaus or shoulders are created between MWD upwell componentry and tapered second section 30 once upwell MWD componentry is threadably connected.

Figure 7:
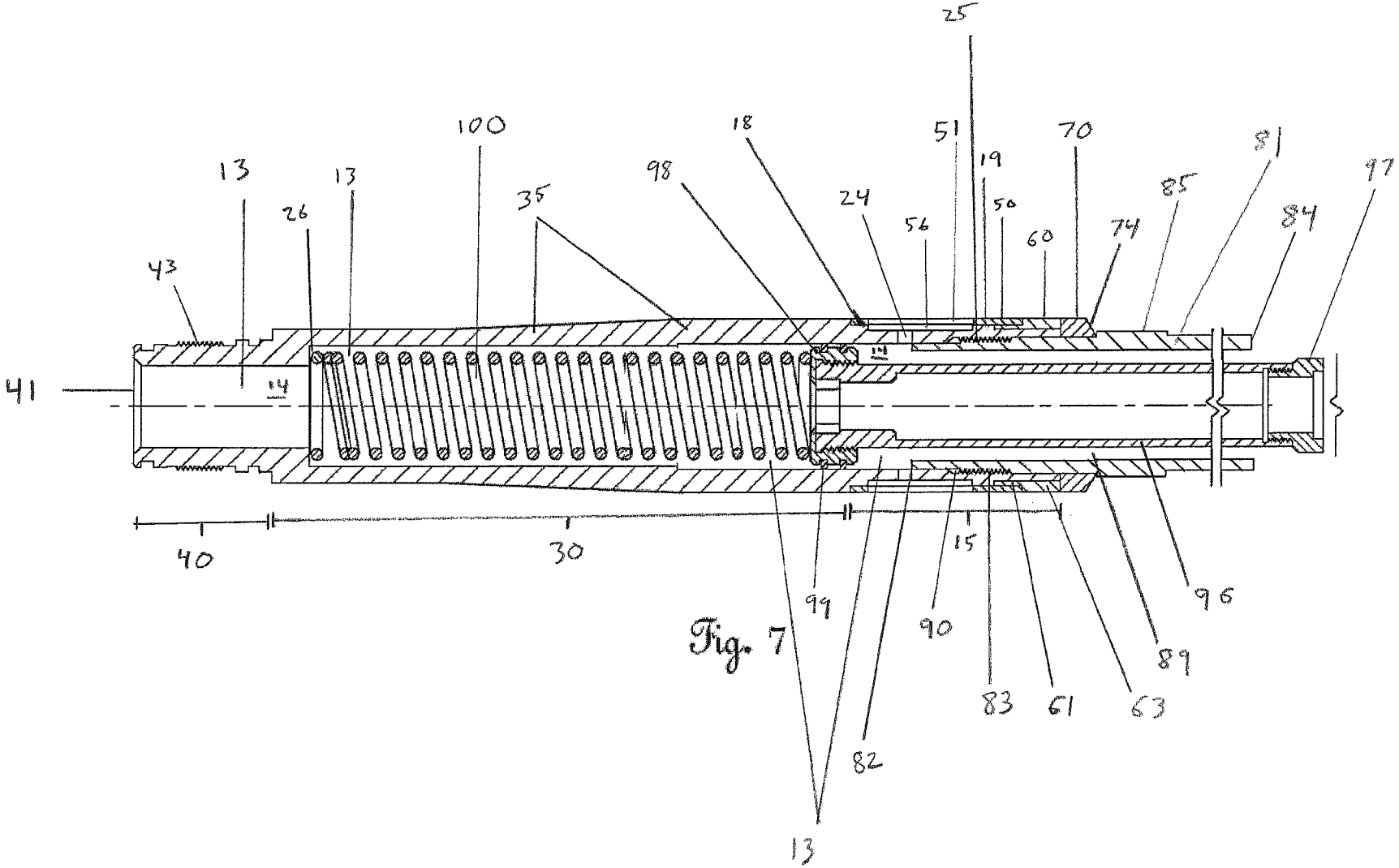
FIG. 7 is an interior cross-sectional view of the preferred embodiment in the lower end of a positive pulse MWD tool including the helix housing.

Tapered second section 30 has varying thicknesses of sidewall 35 resulting in three distinct sections: small diameter section 36, tapered section 37, and large diameter section 38. Small diameter section 36 is located at the upwell end 31. Large diameter section 38 is positioned at the downwell end 32. Connecting the small diameter section 36 and large diameter section 38 is a tapered section 37. Sidewall 35, as seen in FIG. 7, varies in thickness to accommodate the changing diameter in order to maintain an interior cavity of the poppet housing similar to the standard MWD poppet housing. In the preferred embodiment, exterior surface 34 of sidewall 35 is smooth with no breaks as small diameter section 36, tapered section 37, and large diameter section 38 are integral. This allows for ease of insertion into the drill casing and drilling string as the poppet housing 10 does not have any exposed shoulders to get hung up on equipment downhole.

First section 15 has a sidewall 23, an upwell end 16 and a terminal downwell end 17. Upwell end 16 abuts the downwell end 32 of tapered second section 30. First section 15 has a smaller diameter than the large diameter section 38 of the tapered section 30. In the preferred embodiment, the outer diameter of the first section 15 is similar to the small diameter section 36 of the tapered second section 30 and similar to the outer diameter of a traditional poppet housing. Two raised collars 18, 19 of equal diameters are located circumferentially around the sidewall 23 of the first section 15. The upwell raised collar 18 abuts the downwell end 32 of the tapered second section 30. The diameter of the upwell raised collar 18 is smaller than the large diameter section 38 of the tapered second section 30 but larger than the diameter of the first section 15 which results in a shoulder 20 located between the downwell end 32 of the tapered second section 30 and the upwell raised collar 18. The downwell raised collar 19 is located near the terminal downwell end 17 but not physically at the terminus. Downwell shoulder 21 is created between the downwell side of the downwell raised collar 19 and the exterior surface 22 of the sidewall 23. In the preferred embodiment, raised collars 18, 19 are integrally made with into the poppet housing 10.

Figure 3:
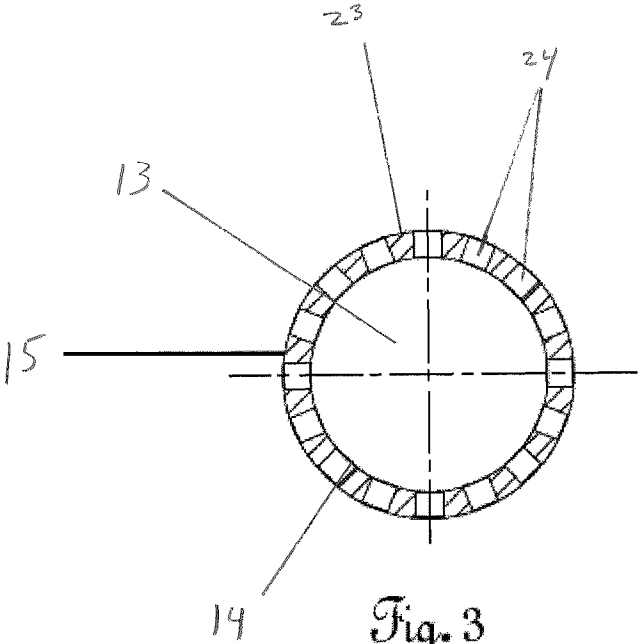
FIG. 3 is a downwell cross sectional view of the preferred embodiment of the first section of the poppet housing at 3-3.

Disposed through the sidewall 23 of first section 15 between the upwell raised collar 18 and the downwell raised collar 19, but located more proximal to the upwell raised collar 18, are fluid ports 24. In the preferred embodiment as seen in FIG. 3, there are sixteen identically sized and equidistantly spaced fluid ports 24 circumferentially disposed through sidewall 23 of the first section 15. In the preferred embodiment, the angle of degree between the center of a fluid port and the center of the next adjacent fluid port is 22.5 degrees and the approximate diameter of each fluid port at the exterior surface 22 is 3/16 of an inch. The location, size, and spacing of the fluid ports 24 are consistent with standard positive pulse MWD componentry.

Fluid ports 24 define a pathway for fluid to enter the interior cavity 13 of the poppet housing 10. The interior cavity 13 includes internal threadable connectors 25 (seen in FIG. 7) positioned on the interior surface 14 of sidewall 23 between the terminal downwell end 17 and the fluid ports 24 on the interior surface of the poppet housing 10. An interior shoulder 26 (seen in FIG. 7) is positioned within the interior cavity 13 towards the upwell end 31 of the tapered second section 30. The interior cavity 13 is substantially similar to existing MWD poppet housings and is well known in the art.

Figure 4:
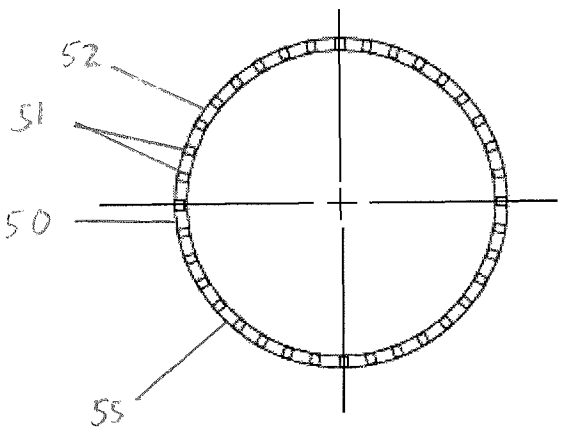
FIG. 4 is a downwell cross sectional view of the preferred embodiment of the housing screen at 4-4 of FIG. 5.
Figure 5:
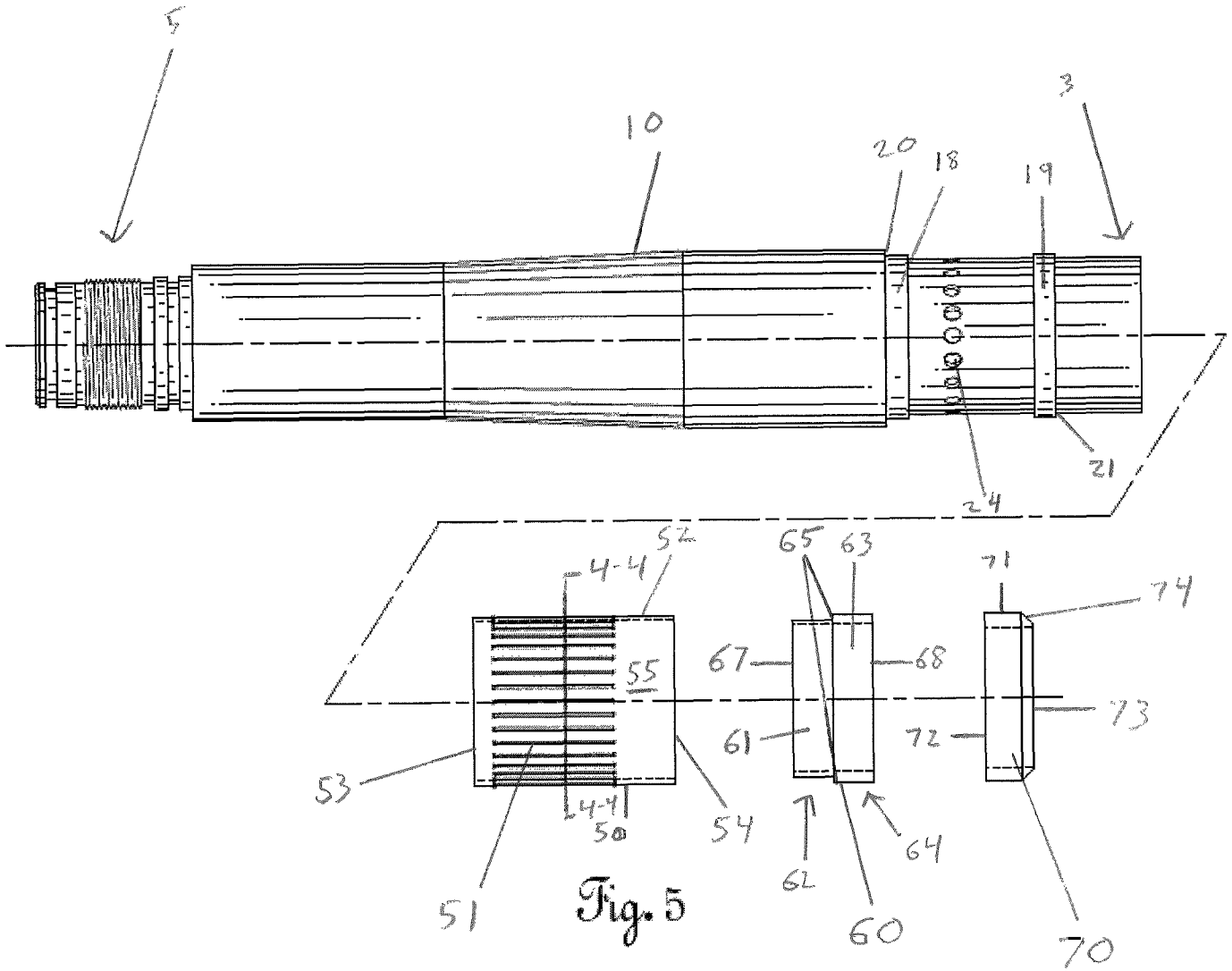
FIG. 5 is an exploded profile view of the preferred embodiment.

FIG. 5 is an exploded view of the preferred embodiment 1. Screen 50 is tubular in structure having a sidewall 52 with an inner and outer diameter, a terminal upwell end 53 and a terminal downwell end 54. In the preferred embodiment, the screen is made of a material with an approximate thickness of 0.075 inches. The outer diameter of the sidewall 52 is approximately equal to the circumference of the large diameter section 38 of the tapered second section 30. Slits 51 are disposed circumferentially through the sidewall 52 and extend longitudinally from near the terminal upwell end 53 to past the mid-point of the screen 50. In the preferred embodiment as seen in FIG. 4, there are thirty-six identically sized and equidistantly spaced slits 51 disposed circumferentially through the sidewall 52 with the angle of degree between the center of a slit and the center of the next adjacent slit is 10 degrees. In the preferred embodiment, the length of the screen is 2.5 inches with the slits 51 beginning approximately 0.25 inches from the terminal upwell end 53 and extending 1.5 inches towards the terminal downwell end 54. In the preferred embodiment the approximate width of each slit is 1/32 of an inch. In the preferred embodiment, screen 50 is machined from stainless steel and is heat treated.

Connector ring 60 is a layered cylindrical shape with a thin sidewall 61 located on the upwell section 62 having an inner and outer diameter. Connector ring 60 also has a thick sidewall 63 located on the downwell section 64 having an inner and outer diameter. In the preferred embodiment, the upwell section 62 and a downwell section 64 are integral. In the preferred embodiment, the inner diameters of the thin sidewall 61 and thick sidewall 63 are equal whereas the outer diameter of the thin sidewall 61 is smaller than that the outer diameter of the thick sidewall 63 resulting in shoulder 65. The outer diameter of thin sidewall 61 is smaller than the inner diameter of screen 50 which allows for upwell section 62 to concentrically fit within screen 50. The outer diameter of thick sidewall 63 is approximately equal to the outer diameter of screen 50. The length of connector ring 60 is approximately equal to the distance between shoulder 20 and the terminal downwell end 17 of the first section 15.

The inner diameter of connector ring 60 is uniform for both the upwell section 62 and downwell section 64. The inner diameter of connector ring 60 is slightly larger than the outer diameter of the first section 15 which allows for an interference or frictional engagement between the interior surface of the connector ring 60 and the exterior surface 22 of the first section 15.

Abrasion ring 70 is cylindrical in shape with a sidewall 71, having an inner and outer diameter, a terminal upwell end 72 and a terminal downwell end 73. The inner diameter of abrasion ring 70 is substantially equal to the inner diameter of terminal downwell end 17 of first section 15. The outer diameter of abrasion ring 70, at the terminal upwell end 72 is substantially equal to the outer diameter of the connector ring 60, outer diameter of screen 50, and the outer diameter of the large diameter section 38 of the tapered second section 30. The thickness of the sidewall 71 at the terminal upwell end 72 is substantially equal to the combined thickness of terminal downwell end 17 of first section 15 and downwell terminal end 68 of connector ring 60, allowing terminal upwell end 72 of abrasion ring 70 to fit flush against terminal downwell end 17 of first section 15 and downwell terminal end 68 of connector ring 60. Terminal downwell end 73 of abrasion ring 70 features a tapered or chamfer edge 74. In the preferred embodiment the chamfer is approximately forty five degrees and 0.188 inches long.

Figure 6:
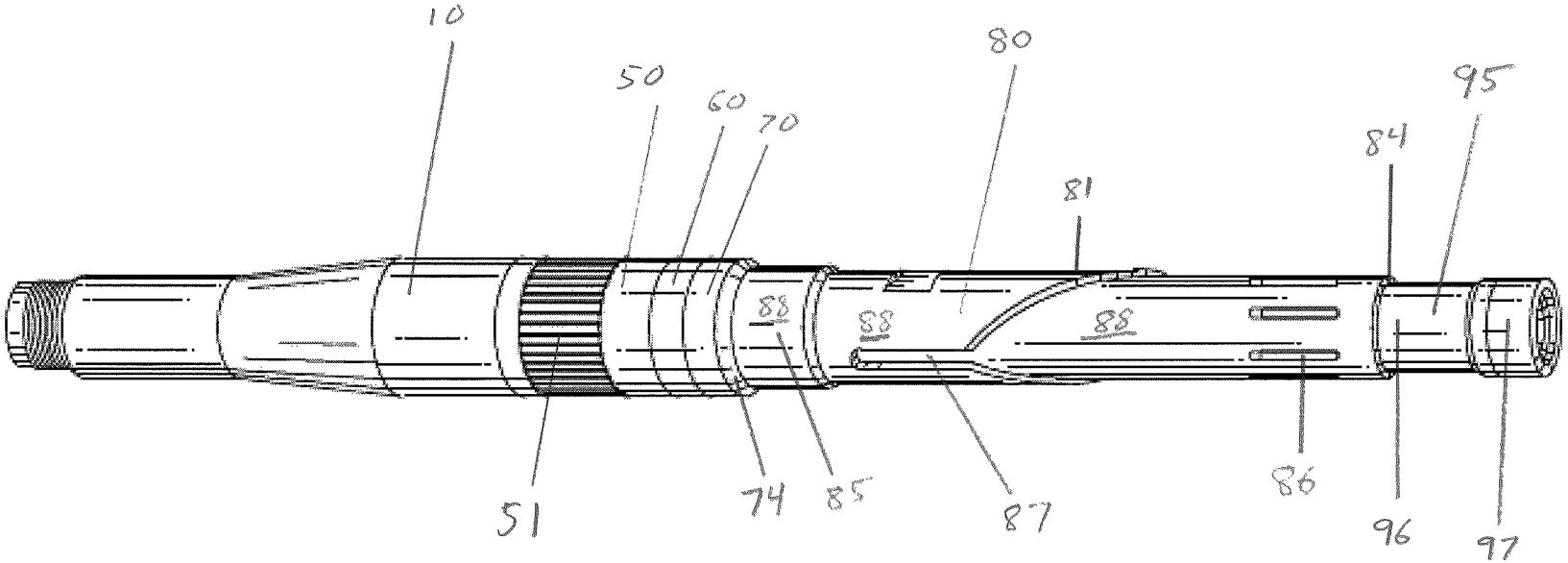
FIG. 6 is a profile view of the preferred embodiment in the lower end of a positive pulse MWD tool including the helix housing.

FIG. 6 shows the preferred embodiment as viewed as part of the positive pulse MWD lower end assembly comprising a poppet housing 10, screen 50, connector ring 60, abrasion ring 70, helix housing 80, and signal shaft 95. Helix housing 80 is generally tubular in shape with a sidewall 81, terminal upwell end 82 (seen in FIG. 7) with external threaded connectors 83, terminal downwell end 84, raised shoulder 85, and vents 86. The exterior diameter of the helix housing 80, from the terminal upwell end to the raised shoulder 85, is smaller than the interior diameter of the first section 25, but large enough for the external threaded connectors 83 and the internal threaded connectors 25 to threadably mate (seen in FIG. 7).

A slotted key receptacle 81 is disposed on the exterior surface 88 of the sidewall 81. Slotted key receptacle 81 is capable of fitting within standard MWD muleshoes to ensure proper placement within the drill string. When fitted in a standard muleshoe, the tapered edge 74 of abrasion ring 70 is positioned against a receiving section of the muleshoe that is inversely proportioned to the tapered edge 74.

Helix housing 80 is well known within the art. Signal shaft 95 is located within interior cavity 89 of helix housing 80 and extends into the interior cavity 13 of poppet housing 10. Signal shaft 95 is comprised of a hollow shaft 96, flow plug 97 located at the downwell end, and a piston 98 (as seen in FIG. 7) located on the upwell end of the hollow shaft 96. Piston 98 has seals 99 located on around its external circumference. Signal shaft 95 is of sufficient length to partially extend beyond terminal downwell end 84 of helix housing 80. Drilling mud may flow from upwell opening 4 through interior cavity 13 and through signal shaft 95 and out flow plug 97.

FIG. 7 is a cross sectional view of FIG. 6. When assembled, screen 50 is concentrically positioned over first section 15 where slits are positioned over fluid ports 24. Terminal upwell end 53 rests over upwell raised collar 18, abutting tapered second section 30 at shoulder 33, and rests over downwell raised collar 19. Due to the raised collars, gap 56 exists between exterior surface 22 of first section and the interior surface of screen 50. Thus a gap exists between the screen 50 and fluid ports 24. Connector ring 60 is then attached to the first section 15 through the frictional engagement as described above. Once in place, terminal upwell end 67 of connector ring 60 abuts downwell raised collar 19 and the downwell terminal end 68 of connector ring 60 lines up with terminal downwell end 17. Screen 50 is prevented from moving longitudinally by shoulder 33 and downwell section 64 of connector ring 60. Any upwell force from connector ring 60 is received by the downwell raised collar 19 and not by the screen 50. This allows the screen 50 to rotate freely around the first section 15 and prevents the slits from opening beyond their designed width as a result of longitudinal compressional forces that occur during assembly and/or insertion of the tool downhole.

Abrasion ring 70 is concentrically positioned over the terminal upwell end 82 with the tapered edge 74 slid towards raised shoulder 85. The terminal downwell end 73 abuts raised shoulder 85 and prevent abrasion ring 70 from moving further downwell.

The terminal upwell end 82 of helix housing 80, with signal shaft 95 located in interior cavity 89, is inserted into poppet housing 10 through downwell opening 4. The external threaded connectors 83 of helix housing 80 threadably mate with internal threadable connectors 25 of first section 15 until abrasion ring 70 is flush terminal downwell end 17 of first section 15 and downwell terminal end 68 of connector ring 60. Raised shoulder 85 further secures the abrasion ring 70 from moving downwell. Seal 90 on helix housing 80 located upwell from external threaded connectors 83 seals against interior surface 14 of poppet housing 10.

Piston 98 of signal shaft 95 has a series of seals 99 that engage the interior surface 14 of poppet housing 10, creating a barrier to prevent fluid from passing around the outside of the signal shaft 95. Piston 98 is positioned upwell from fluid ports 24. Spring 100 engages the head 99 of signal shaft 95 with the other end of the spring 100 positioned against interior shoulder 26 of the poppet housing. Depending on the pressure of drilling mud entering slits 51 and into fluid ports 24, the signal shaft 95 may move upwell or downwell. In operation, the signal shaft 95 moves longitudinally along the wellbore in relation to the poppet housing 10 and helix housing 80.

In operation, drilling mud flows between slits 51 of screen 50 and into the gap 56. From gap 56, drilling mud flows into the fluid ports 24 and into the interior cavity 13 of the poppet housing 10. Screen 50 prevents LCM and other debris from entering the fluid ports. In the preferred embodiment screen 50 is capable of filtering particles that have a smallest dimension of 1/32 of an inch. Only particles in which the maximum dimension is less than 1/32 of an inch may pass through slits 53.

In contrast, particles in which the maximum dimension is less than 3/16 of an inch may pass through fluid ports 24.

Once the drilling mud enters the interior cavity 13, it acts on signal shaft 95 in the same manner as traditional positive pulse MWD systems known in the art. In the preferred embodiment, the amount of the drilling mud entering fluid ports 24 is the same as drilling mud entering the standard fluid ports in standard positive pulse MWD systems.

Overall the High LCM Positive Pulse MWD Component functions identically in regard to traditional positive pulse MWD components in that functionality and operational aspects of the positive pulse methods function as known in the art. However, due to the screen and design of the high LCM positive pulse MWD component, the system may function in a high LCM environment without suffering from clogging and reduced efficiency in the operation of drilling. A further advantage of the present invention is the ability to replace the screen without having to replace other parts or portions of the lower end assembly.

The present invention is described above in terms of a preferred illustrative embodiment of a specifically-described High LCM Positive Pulse MWD Component. Those skilled in the art will recognize that alternative constructions of such an apparatus can be used in carrying out the present invention. Other aspects, features, and advantages of the present invention may be obtained from a study of this disclosure and the drawings, along with the appended claims.

I claim:

1. A positive pulse measuring device component comprising:

a cylindrical poppet housing further comprising a first poppet housing section having a side wall, a first end, a second end, and at least one opening disposed through said side wall allowing fluid communication between the interior and exterior of said first poppet housing section;

a tapered second poppet housing section having a side wall, a first end, and a second end positioned adjacent said first end of said first poppet housing section wherein said second end of said tapered second poppet housing section has a greater outer diameter than said first end of said tapered second poppet housing section and said first poppet housing section; and a housing screen having at least one aperture positioned over a portion of said first poppet housing section having said at least one opening and abutting said second end of said tapered second poppet housing section wherein said housing screen filters particles that would otherwise pass into said interior of said first poppet housing section through said at least one opening.

2. A positive pulse measuring device component according to claim 1 wherein said at least one opening disposed through said side wall further comprises a plurality of holes arranged circumferentially around said first poppet housing section.

3. A positive pulse measuring device component according to claim 1 wherein said at least one aperture comprises a plurality of slits.

4. A positive pulse measuring device component to claim 3 wherein said slit has a width of 1/32 inches.

5. A positive pulse measuring device component according to claim 3 wherein said plurality of slits are arranged longitudinally along said housing screen.

6. A positive pulse measuring device component according to claim 1 further comprising a first ring wherein said housing screen is positioned between said second end of said tapered second poppet housing section and said first ring.

7. A positive pulse measuring device component according to claim 6 wherein said first ring is attached to said second end of said first poppet housing section.

8. A positive pulse measuring device component according to claim 7 further comprising at least one raised collar located on the outer surface of said first poppet housing section wherein said first ring abuts one of said at least one raised collar.

9. A positive pulse measuring device component according to claim 8 wherein said housing screen is positioned over and rotates freely over said at least one collar.

10. A positive pulse measuring device component according to claim 8 wherein the length of said first ring and the distance between said one of said at least one raised collar and the terminal end of said second end of first poppet housing section are substantially equal.

11. A positive pulse measuring device component according to claim 10 further comprising a second ring having a first end and a second end wherein said first ring is positioned between said first end of said second ring and said housing screen.

12. A positive pulse measuring device component according to claim 11 wherein the outer diameter of said housing screen, the outer diameter of said second end of said tapered second poppet housing section, the outer diameter of said first ring, and the outer diameter of said first ring, and outer diameter of said second ring are substantially equal.

13. A positive pulse measuring device component according to claim 11 wherein said second end of said second ring is tapered.

14. A positive pulse measuring device component according to claim 11 wherein the inner diameter of said second end of first poppet housing section and the inner diameter of said second ring are substantially equal.

15. A positive pulse measuring device component according to claim 6 wherein the outer diameter of said housing screen, the outer diameter of said second end of said tapered second poppet housing section and the outer diameter of said first ring are substantially equal.

16. A positive pulse measuring device component according to claim 1 wherein said first poppet housing section and said second poppet housing section are integral.

17. A positive pulse measuring device component according to claim 1 wherein the inner diameter of said first poppet housing section is substantially equal to the inner diameter of said tapered second poppet housing section at said first end of said first poppet housing section and said second end of said second poppet housing section.

18. A positive pulse measuring device component according to claim 1 wherein the outer diameter of said housing screen is substantially equal to the outer diameter of said second end of said tapered second poppet housing section.

19. A positive pulse measuring device component according to claim 1 wherein said housing screen rotates around said first cylindrical poppet housing section.

20. A positive pulse measuring device component according to claim 1 wherein said housing screen is capable of filtering particles having a smallest dimension of 1/32 inch.

* * * * *